United States Patent [19]

Schurig et al.

[11] 4,444,639

[45] Apr. 24, 1984

[54] ELECTROLYZER

[75] Inventors: Helmuth Schurig, Holzwickede; Helmut Schmitt, Dortmund, both of Fed. Rep. of Germany

[73] Assignee: UHDE GmbH, Dortmund, Fed. Rep. of Germany

[21] Appl. No.: 402,306

[22] Filed: Jul. 27, 1982

[30] Foreign Application Priority Data

Aug. 20, 1981 [DE] Fed. Rep. of Germany ..... 3132947

[51] Int. Cl.[3] ..... C25B 9/02; C25B 13/02; C25C 7/04

[52] U.S. Cl. ..... 204/257; 204/263; 204/279; 204/282

[58] Field of Search ..... 204/252–258, 204/263–266, 279, 283, 288, 289, 282

[56] References Cited

U.S. PATENT DOCUMENTS

| | | | |
|---|---|---|---|
| 4,056,452 | 11/1977 | Campbell | 204/258 |
| 4,279,731 | 7/1981 | Pellegri | 204/254 |
| 4,331,521 | 5/1982 | Chisholm et al. | 204/98 |
| 4,343,690 | 8/1982 | De Nora | 204/263 |
| 4,364,815 | 12/1982 | Darlington et al. | 204/283 |
| 4,374,014 | 2/1983 | Smith et al. | 204/260 |
| 4,381,979 | 5/1983 | De Nora et al. | 204/98 |

FOREIGN PATENT DOCUMENTS

| | | | |
|---|---|---|---|
| 1252643 | 10/1967 | Fed. Rep. of Germany | 204/256 |
| 4914465 | 5/1970 | Japan | 204/279 |

*Primary Examiner*—Howard S. Williams
*Assistant Examiner*—T. L. Williams
*Attorney, Agent, or Firm*—Fraser, Barker, Purdue & Clemens

[57] ABSTRACT

An electrolyzer is provided which includes at least one set of closely spaced electrode assemblies consisting of a flat anode and a flat cathode separated by a membrane permeable to ions. One side of the electrode assembly is supported by a rigid pressure plate while a flexible pressure plate disposed along the opposite side of the electrode assembly biased the anode and cathode towards each other. The flexible pressure plate includes a flat portion having contact pads struck and formed therefrom. The contact pads are sized to cover from 30 to 70% of the overall plate surface and include portions which are plane-parallel to the flat portion. The contact pads bent to one side are designed to be vertical on a longitudinal axis after mounting of the flexible pressure plate in an electrolyzer.

2 Claims, 3 Drawing Figures

ELECTROLYZER

BACKGROUND OF THE INVENTION

The invention relates to an electrolyzer suitable for the production of chlorine and caustic alkalies from an aqueous alkaline chloride solution. The electrolyzer normally consists of a plurality of electrolyzer elements assembled in the manner of a filter-press.

Electrodes, i.e., anodes and cathodes, must be in as close a contact as possible with an intermediate membrane or diaphragm, but arranged in such a manner that the membrane or diaphragm is not damaged due to excessive contact pressure, thus causing metallic contact between the anode and cathode.

German Pat. No. DE-PS-12 52 643 describes an electrolyzer including a diaphragm or membrane which is arranged between an anode and a cathode, such diaphragm consisting of a non-conductive porous asbestos and the membrane being made of an ion exchanger resin. According to the patent, the anode and cathode are placed directly on the diaphragm. The elements are permeable such that the products can be withdrawn from the electrolyzer. The cathode, which has an asbestos fiber layer constituting a diaphragm, is pressed against the anode by means of a flexible support of the electrodes. This method, however, does not ensure a uniform surface contact of anode and diaphragm.

German Pat. No. DE-OS 30 28 970 describes a design in which an anode and a cathode are in a direct multipoint contact with the membrane via a conductive flexible layer. For this purpose, a flexible current collector is used and combined with a rigid support plate. The current collector is a mesh of 0.15 mm. nickel wire. Since there is only a linear or multi-point contact of the two adjacent cathode elements, the contact surface is relatively small in relation to the overall cathode surface. This configuration causes a substantial voltage drop.

SUMMARY OF THE INVENTION

The object of the present invention is to overcome the inconveniences of the known electrolyzer design.

The object of the invention is produced by using a flat anode and a flat cathode element, which are permeable to gas and liquid and separated by a non-conductive membrane, in conjunction with a support structure which biases the elements into contact.

One component of the support structure is designed as a rigid pressure plate member and another component is designed as a flexible pressure plate member.

A further embodiment of the invention provides for a flexible pressure plate support structure consisting of a flat conductive metal portion and contact pads pressed and bent to protrude from the flat portion. The surface of the contact pads covers 30 to 70% of the overall plate surface and the major part of each pad is plane-parallel to the plate surface.

In order to facilitate the upward flow of the electrolysis products in the electrolyzer, a further embodiment of the invention provides for the contact pads, which are bent outwards, being arranged vertically in the longitudinal direction and being in contact with the electrode after mounting the flexible pressure plate.

A particular advantage achieved by the invention is that the number of electrode components and, consequently, the number of contact points with a high resistance to the current flow is reduced. The contact pads have a width of approximately 3 to 5 mm. and thus offer a substantially larger contact surface than a mesh structure. The flexibility of the flexible pressure plate depends on the shape of the contact pads bent upwards and is rated such that the membrane arranged between anode and cathode is not damaged due to excessive contact pressure.

BRIEF DESCRIPTION OF THE DRAWINGS

Various features of the invention are illustrated in the accompanying drawings and described in more detail below when considered in light of the drawings, in which.

DETAILED DESCRIPTION OF THE PREFERRED EMBODIMENT

Figure 1:
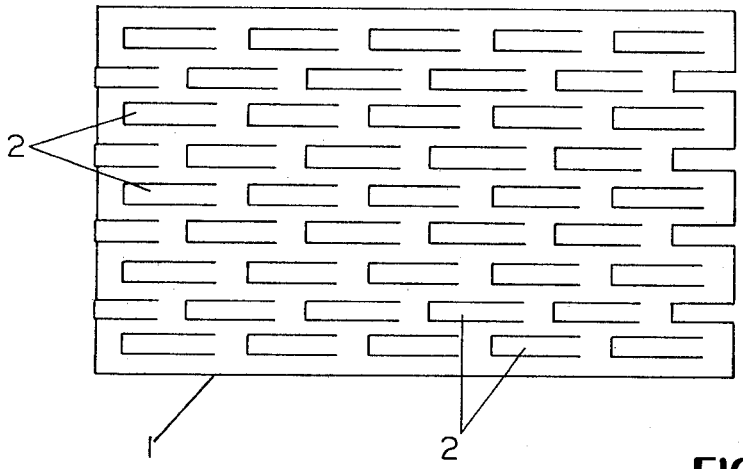
FIG. 1 is a top view of a flexible pressure plate support structure.
Figure 2:
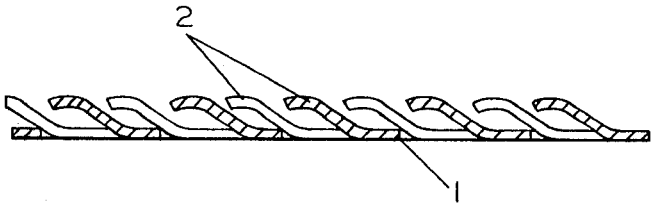
FIG. 2 is a cross sectional view of the flexible pressure plate taken substantially along line 2-2 of FIG. 1.

A flexible support plate 1 of chrome steel (300×600×1 mm.) is formed and bent in a press to the shape as illustrated in FIGS. 1 and 2 with contact pads 2. A number of contact pads 2 are produced in alternately spaced rows and formed to the shape illustrated in FIG. 2. The ratio of the surface of the plate 1 and the plane-parallel parts of the contact pads 2 is approximately 1:1.

The front edges of the contact pads are chamfered and bent slightly downwardly so as to prevent any deterioration of the thin anode.

Figure 3:
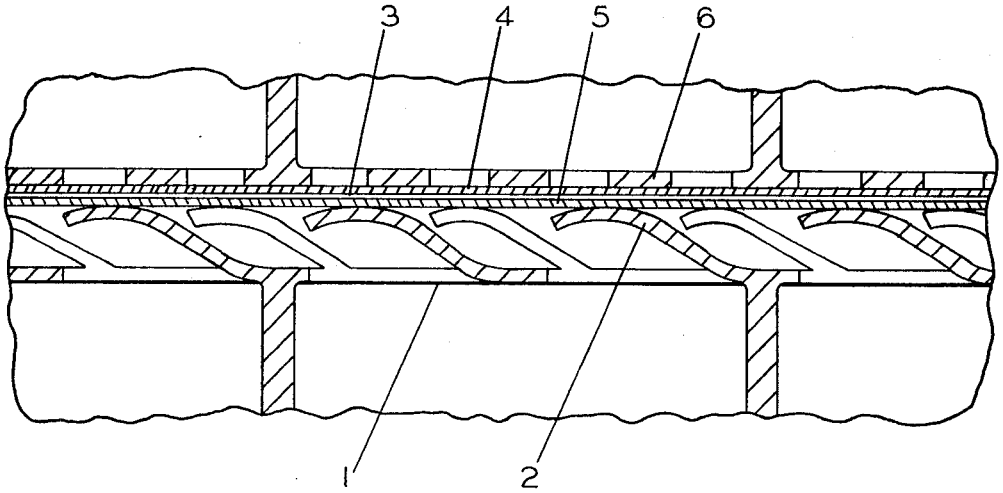
FIG. 3 is a fragmentary cross sectional view of the flexible pressure plate incorporated in an electrolyzer.

FIG. 3 illustrates the assembly, in cross section, of the inventive flexible pressure plate, anode, and cathode design. An anode 4 and a cathode 5 are positioned in as close a contact as possible with a membrane 3. A rigid pressure plate 6 is the support element for the flexible pressure plate 1. The design is such that the flexible pressure plate 1 ensures a full surface contact of anode 4, membrane 3, and cathode 5.

What is claimed is:

1. In an electrolyzer of the type having a cell housing, facilities for feeding the electrolyte and withdrawing the electrolysis products, means for conducting electric current and at least one cathode and anode assembly consisting of an anode and a cathode separated by a membrane permeable to ions, the improvement comprising: said anode and said cathode each consisting of a flat element permeable to gas and liquid; a rigid pressure plate disposed along one side of said anode and cathode assembly; and a flexible pressure plate disposed along the other side of said anode and cathode assembly, said flexible pressure plate comprising a conductive metal plate including a number of rows of alternately spaced contact pads pressed and bent to one side for producing surfaces contacting said other side of said cathode and anode assembly, the contacting surfaces of said contact pads covering 30 to 70% of said other side of said anode and cathode assembly and the contacting surface of each said contacting pad being plane-parallel to said other side of said cathode and anode assembly, whereby said anode and said cathode are biased towards each other to produce a full surface contact between said anode, said membrane and said cathode.

2. The invention defined in claim 1, wherein said contact pads bent to one side are vertical on a longitudinal axis after mounting said flexible pressure plate in the electrolyzer.

* * * * *